US011589669B2

(12) United States Patent
Delgigante et al.

(10) Patent No.: US 11,589,669 B2
(45) Date of Patent: Feb. 28, 2023

(54) TOILET BRUSH WITH DETACHABLE BRUSH HEAD

(71) Applicant: Reckitt Benckiser LLC, Parsippany, NJ (US)

(72) Inventors: Jesse Delgigante, Verona, NJ (US); Rens Jurian Hoeke, Eindhoven (NL); David Stephen Thomas, Cambridge (GB); Ross Weir, Cambridge (GB); Geoff Woo, Seattle, WA (US); Peter Atkins, Montvale, NJ (US)

(73) Assignee: Reckitt Benckiser LLC, Parsippay, NJ (US)

( * ) Notice: Subject to any disclaimer, the term of this patent is extended or adjusted under 35 U.S.C. 154(b) by 418 days.

(21) Appl. No.: 16/638,649

(22) PCT Filed: Sep. 13, 2018

(86) PCT No.: PCT/GB2018/052605

§ 371 (c)(1),
(2) Date: Feb. 12, 2020

(87) PCT Pub. No.: WO2019/053437

PCT Pub. Date: Mar. 21, 2019

(65) Prior Publication Data

US 2020/0367635 A1 Nov. 26, 2020

(30) Foreign Application Priority Data

Sep. 13, 2017 (GB) ..... 1714687

(51) Int. Cl.

| | |
|---|---|
| ***A46B 5/00*** | (2006.01) |
| ***A47K 11/10*** | (2006.01) |
| ***A46B 9/00*** | (2006.01) |

(52) U.S. Cl.
CPC ..... *A46B 5/0095* (2013.01); *A46B 9/005* (2013.01); *A47K 11/10* (2013.01); *A46B 2200/304* (2013.01)

(58) Field of Classification Search
CPC . A47K 11/10; A46B 5/0095; A46B 2200/304; A46B 9/005; A46B 7/04;
(Continued)

(56) References Cited

U.S. PATENT DOCUMENTS

| | | | |
|---|---|---|---|
| 6,701,540 | B1 | 3/2004 | Gabriel |
| 7,530,138 | B1 | 5/2009 | Platt |

(Continued)

FOREIGN PATENT DOCUMENTS

| | | | |
|---|---|---|---|
| CN | 101482209 | A | 7/2009 |
| DE | 19938787 | A1 | 5/2000 |

(Continued)

OTHER PUBLICATIONS

International Search Report and Written Opinion of the International Searching Authority for corresponding application PCT/GB2018/052605 dated Dec. 4, 2018.

(Continued)

*Primary Examiner* — Patrick M. Buechner
(74) *Attorney, Agent, or Firm* — Norris McLaughlin PA

(57) ABSTRACT

Brush, in particular toilet brush, with a brush head and a handle. The brush head can be detachably pushed onto the handle. The handle has a release mechanism for the brush head.

19 Claims, 9 Drawing Sheets

(58) Field of Classification Search
CPC ..... A46B 7/042; A46B 7/044; B25G 3/14; B25G 3/12
See application file for complete search history.

(56) References Cited

U.S. PATENT DOCUMENTS

| | | | | |
|---|---|---|---|---|
| D859,852 | S * | 9/2019 | Laude | A47K 11/10 D4/137 |
| 2004/0064907 | A1 | 4/2004 | Blaustein et al. | |
| 2004/0255418 | A1 * | 12/2004 | Minkler | A47K 11/10 15/210.1 |
| 2005/0066465 | A1 | 3/2005 | Minkler et al. | |
| 2005/0204499 | A1 | 9/2005 | Jackson | |
| 2007/0089224 | A1 | 4/2007 | Wildauer et al. | |
| 2008/0244851 | A1 * | 10/2008 | Sutherland | A46B 13/008 15/176.1 |
| 2008/0250588 | A1 | 10/2008 | Robinson et al. | |
| 2009/0106922 | A1 | 4/2009 | Groendahl | |
| 2014/0251844 | A1 | 9/2014 | Michelson et al. | |
| 2015/0374183 | A1 | 12/2015 | Henry | |

FOREIGN PATENT DOCUMENTS

| | | | | |
|---|---|---|---|---|
| GB | 2418602 A | * | 4/2006 | A47K 11/10 |
| JP | 2003339443 A | | 12/2003 | |

OTHER PUBLICATIONS

GB Search Report for corresponding application GB 1714687.9 dated Aug. 23, 2018.
2nd Chinese Office Action and English Translation of the 2nd Chinese Office Action issued in corresponding application CN 201880058575.5 dated Jan. 24, 2022.

* cited by examiner

TOILET BRUSH WITH DETACHABLE BRUSH HEAD

This is an application filed under 35 USC 371 based on PCT/GB2018/052605, filed 13 Sep. 2018, which in turn is based on GB 1714687.9 filed 13 Sep. 2017. The present application claims the full priority benefit of these prior applications and herein incorporates by reference the full disclosures of these prior applications.

The present disclosure relates generally to a handle for cleaning purposes and, more specifically, to a handle having a disposable cleaning head.

Traditional brushes, in particular toilet brushes, pose a hygienic problem because the cleaning head provides a fertile medium for bacteria and fungi. In addition to the unattractive appearance of the brush after repeated use, the contamination of the cleaning head can lead to health hazards for the user.

Accordingly, what is needed in the art is a toilet brush that addresses the above-discussed issues.

According to a first aspect of the invention there is provided a brush, in particular toilet brush, with a brush head and a handle, wherein the brush head can be detachably pushed onto the handle, wherein the handle has a release mechanism for the brush head, wherein the brush head has a handle engagement means which comprises an opening configured to accept the handle, the opening having a gripping mechanism comprised of teeth formed by slots radiating outwardly from the opening, said teeth being suitable for gripping the handle and said teeth being flexible enough that a user can insert the handle into the opening for its retention, wherein the handle comprises a recessed lip to be retained by the teeth.

It has been found that the brush of the invention is particularly advantageous.

The principal advantage stems from the unique structure of the brush. By making the handle in the form of a male member and the brush head in the form of a female member these advantages are realised. This is contrary to the usual format for brushes of this kind.

The advantages include a lightness of the overall brush and especially the brush head. Furthermore, it has been found the brush head lends itself to facile packaging: due to the absence of a male protuberance on the brush section the brush section can be packed (stacked) in secondary packaging with ease. Smaller secondary packaging can be used.

A further advantage is ease of use: in use it is extremely facile to add/remove a brush head. With the addition of a new brush head exemplary brush operation (most preferably toilet/sanitary ware cleaning) can be achieved. This can be achieved with transfer of any soil/micro-organisms from a prior cleaning operation (although the head does not necessarily have to be replaced for a new brush operation). Additionally, the brush head removal mechanism allows/permits for brush head removal without the user having to physically touch the head per se. The brush allows for non-contact removal of the head into a suitable receiving receptacle (e.g. such as a bin). Thus, the user is convenienced in that they do not have to contact the head (and its associated soil).

Generally, the recessed lip includes a handle section of narrower bore. This section is preferably a small distance from the tip of the handle. In this way it has been found that the handle can be advanced to the teeth, pushing them backwards and then the lip goes behind the teeth. In this way the handle is securely retained by the teeth.

Preferably the gripping mechanism includes three teeth.

The teeth generally comprise a resilient material (such as rubber). In this way the teeth are able to accept the handle (by being displaced) and then engage the handle behind the lip.

The teeth have been found to be advantageous in that they present a planer surface (especially when not joined to the handle). This facilitates facile packaging (as discussed above). In an example, the teeth are arranged so that the back plate forms a planar surface. The teeth may be arranged to be co-planar to the back plate. The teeth may also be arranged to angle away from the back plate. For example, the teeth may be arranged to angle inwards from the back plate. Angling the teeth inwards so that the teeth do not protrude from the planar surface of the back plate allows the brush heads to be easily packaged.

Preferably the release mechanism for the brush head comprises a sleeve which can slide on the handle. Generally, the sleeve terminates in a plurality of rods which, on activation, cause disengagement of the teeth with the handle. The disengagement generally comprises movement of the teeth toward the tip of the handle such that they disengage from the lip. In this way the handle can be removed from the gripping mechanism.

In an example, the release mechanism comprises a trigger that is coupled at an upper section (distal end) of the handle to a shaft. The shaft extends along the inside of the handle and is coupled to the ejection rods at the proximal end of the handle. In an example the shaft comprises a bevelled surface at the proximal end that pushes the teeth toward the tip of the handle to push the brush head axially off the lower section (proximal end) of the handle and disengage the handle from the brush head. The ejection rods exert a force on some of the teeth of the brush head. For example, the ejection rods may exert a force on two of the three teeth to remove the brush head from the handle.

Preferably the release mechanism can be moved by a pushbutton/trigger. The release mechanism may be biased into a position in which it is in a non-active form. Preferred forms of biasing means include springs. The pushbutton/trigger is preferably operated against the force provided by the biasing means.

As discussed above, the user activates the release mechanism by a push button or trigger. The release mechanism may be levered so that the distance the user moves the push button or trigger differs from the resulting distance moved by the ejection rods. For example, the release mechanism may be levered so that the distance moved by the ejection rods is less than the distance the user moves the button or trigger. This reduces the force required for the user activate the release mechanism. In an example, moving the button or trigger leads to the ejection rods moving between 0.8 and 0.3 of the distance moved by the button or trigger, for example moving the button or trigger leads to the ejection rods moving between 0.6 and 0.4 of the distance moved by the button or trigger, for example moving the button or trigger leads to the ejection rods moving 0.5 of the distance moved by the button or trigger.

In an example, the release mechanism comprises a curved section adjacent to the button or trigger. The curved section has a spring action and helps to transfer the force from the button or trigger to the ejection rods. This simple mechanism has a small number of parts and provides a more reliable mechanism which is cheaper and easier to manufacture.

Generally, the brush head comprise a back plate which includes the opening.

Preferably the brush head comprises a brushing section adjacent to the back plate and distant from the handle.

Preferably the brushing section may comprise a volume of sponge/foam such as a polyurethane sponge.

Alternatively/additionally the brushing section may comprise bristles.

Alternatively/additionally the brushing section may comprise a pad/sheet formed of a non-woven/woven material. Preferably the pad comprises a cellulose material.

The brushing section may be impregnated/coated with a toilet cleaning formulation. Preferably this formulation comprises a viscous liquid.

A preferred formulation is below.

| wt % | |
|---|---|
| Water | Balance |
| Formic Acid | 20.0 |
| Sodium (C10-16) benzenesulfonate | 2.5 |
| Sodium Lauryl Sulfate | 4.0 |
| Fragrance | 3.0 |
| Dye | 0.1 |

The handle may preferably comprise multiple sections. In a preferred embodiment the handle comprises an upper portion and a lower portion. The upper portion is preferably intended to be held by a consumer (preferably manually in their hand) during use of the brush. As such the upper portion may be shaped so as to fit more ergonomically into a user's hand.

According to a second aspect of the invention there is provided a brush head comprises a back plate and a brushing section, wherein the back plate includes an opening having a gripping mechanism comprised of teeth formed by slots radiating outwardly from the opening. said teeth being suitable for gripping the handle and said teeth being flexible enough that a user can insert the handle into the opening for its retention.

According to a third aspect of the invention there is provided a kit comprising a handle and a number of brush heads.

According to a fourth aspect of the invention there is provided a method of cleaning a toilet/sanitary appliance.

Generally, the method includes a) attachment of a brush head to a handle;

b) performance of a cleaning operation;

c) removal and optionally disposal of the used brush head.

It has been found that the attachment/separation of the brush head and handle occurs with a satisfying haptic feedback. The attachment/separation has an audible and tangible click, which provides a useful sonic indication that the operation is complete. The separation of the brush head and handle occurs quickly, which consumers find satisfying.

DESCRIPTION OF THE DRAWINGS

The invention will now be described with reference to the following non-limited figures in which.

With reference to FIGS. 1 and 2 it can be seen that the device (1) of the invention comprises two sections; a handle (2) and a brush head (3).

Figure 1:
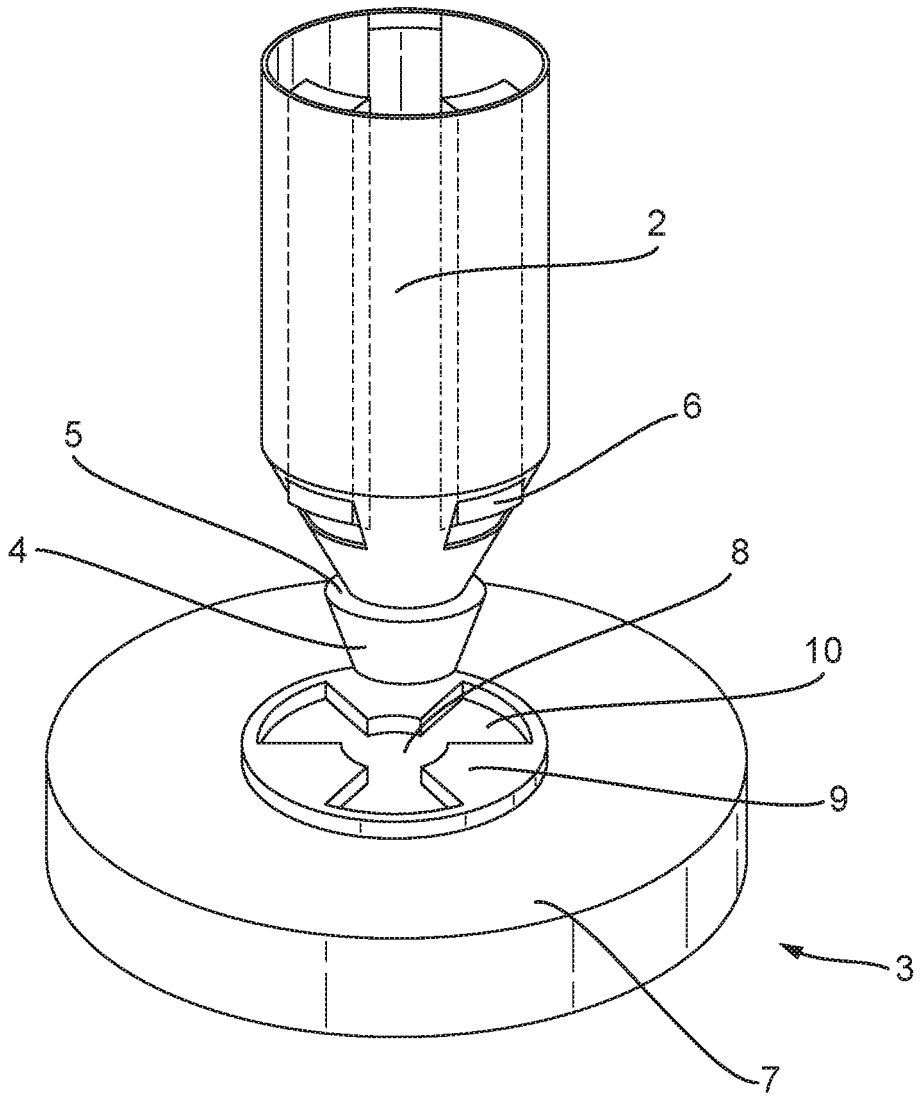
FIG. 1(*a-c*), FIG. 2(*a-c*)
Figure 2:
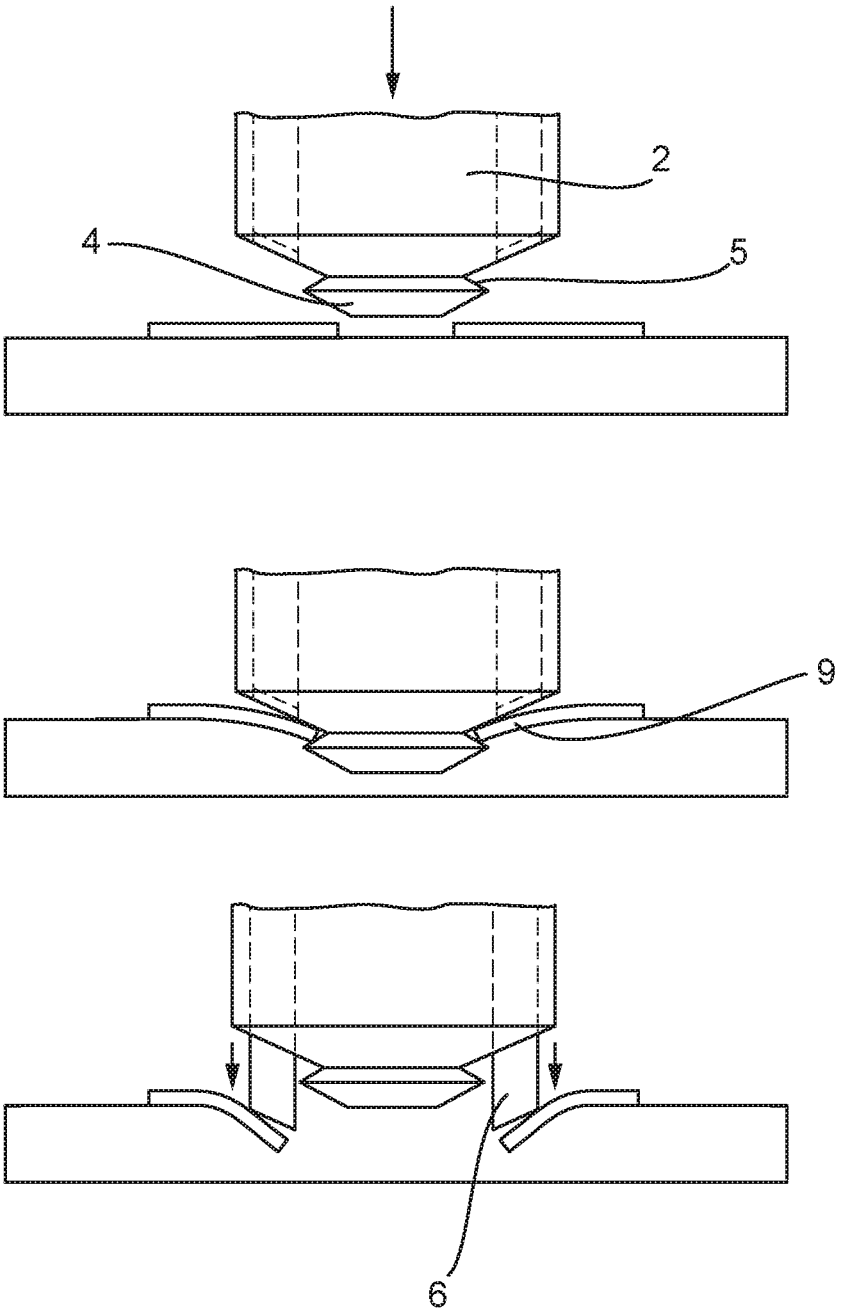

The handle (2) is largely rod like. The handle (2) terminates in a bayonet section (4). The bayonet section (4) has a recessed lip section (5). The handle also has a release mechanism. The release mechanism comprises a plurality of rods (6). The rods (6) are arranged close to the perimeter of the handle (2). When activated (such as by a pushbutton (not shown) the rods (6) bring about disengagement of the handle (2) and the brush head (3).

The brush head (3) has a back plate (7). The back plate (7) includes an opening (8) configured to accept the bayonet section (4). The opening (8) has a gripping mechanism comprised of teeth (9). The teeth (9) are formed by slots (10) radiating outwardly from the opening (8). The teeth (9) are suitable for gripping the bayonet section (4) (and hence the handle (2)). The teeth (9) are flexible enough that a user can insert the bayonet section (4) into the opening (8) for its retention. The teeth (9) comprise a resilient material such as rubber.

Adjacent the back plate (7) is a brush section (10). The brush section (10) comprises a volume of sponge/foam such as a polyurethane sponge.

In assembly the section (4) is present to the opening (8) and pushed until the bayonet section (4) passes beyond the teeth (9) until the teeth (9) engage with the recessed lip section (5).

Then a brushing operation can occur.

In removal an operating element (not shown) causes the rods (6) to slide down the handle (2) in the direction of the brush head (3). The rods (6) engage the teeth (9) and push the teeth (9) away from the handle (2) such that the engagement with the recessed lip section (5) is broken. The brush head (3) can then be separated from the handle (2). This operation is preferably carried out above a receptacle, such as a reuse bin, so that the user does not have to contact the soiled brush head (3).

Figure 3:
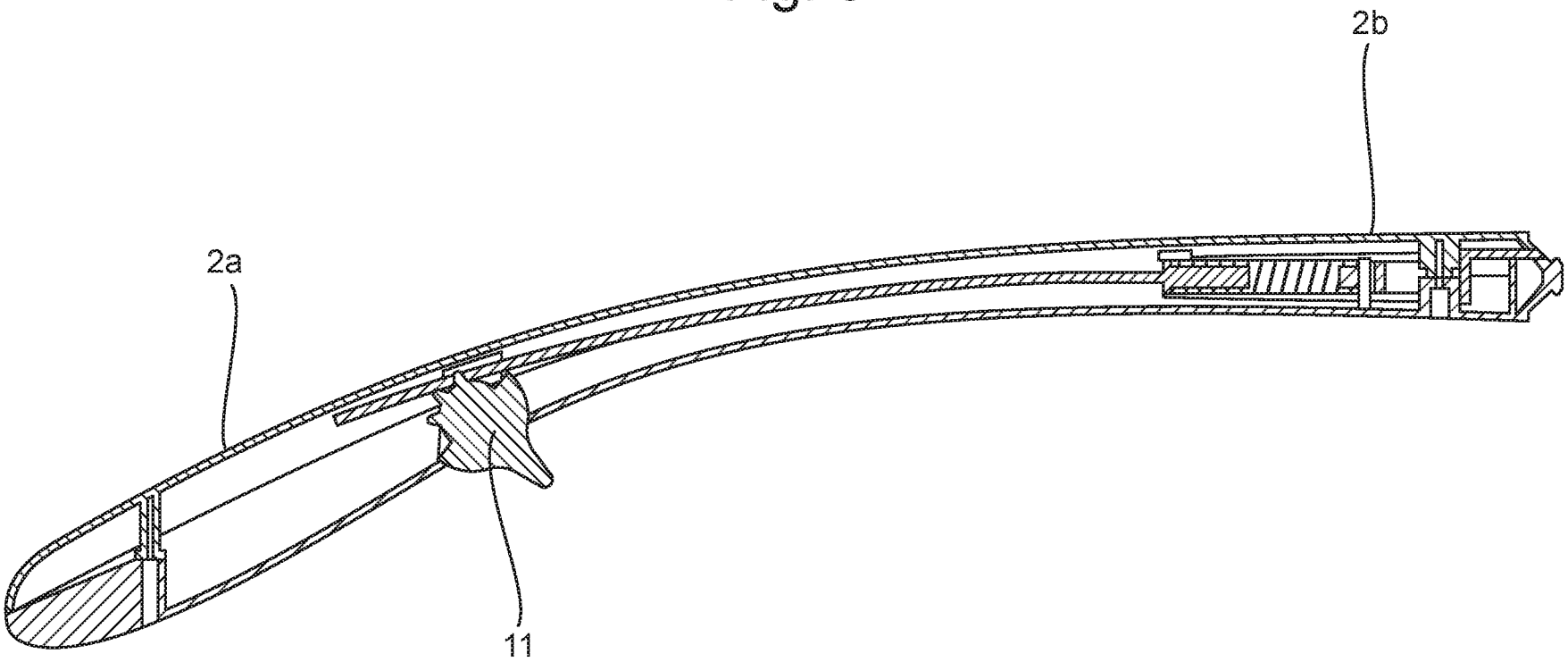
FIG. 3 and FIG. 4 are views of a first embodiment of the invention.
Figure 4:
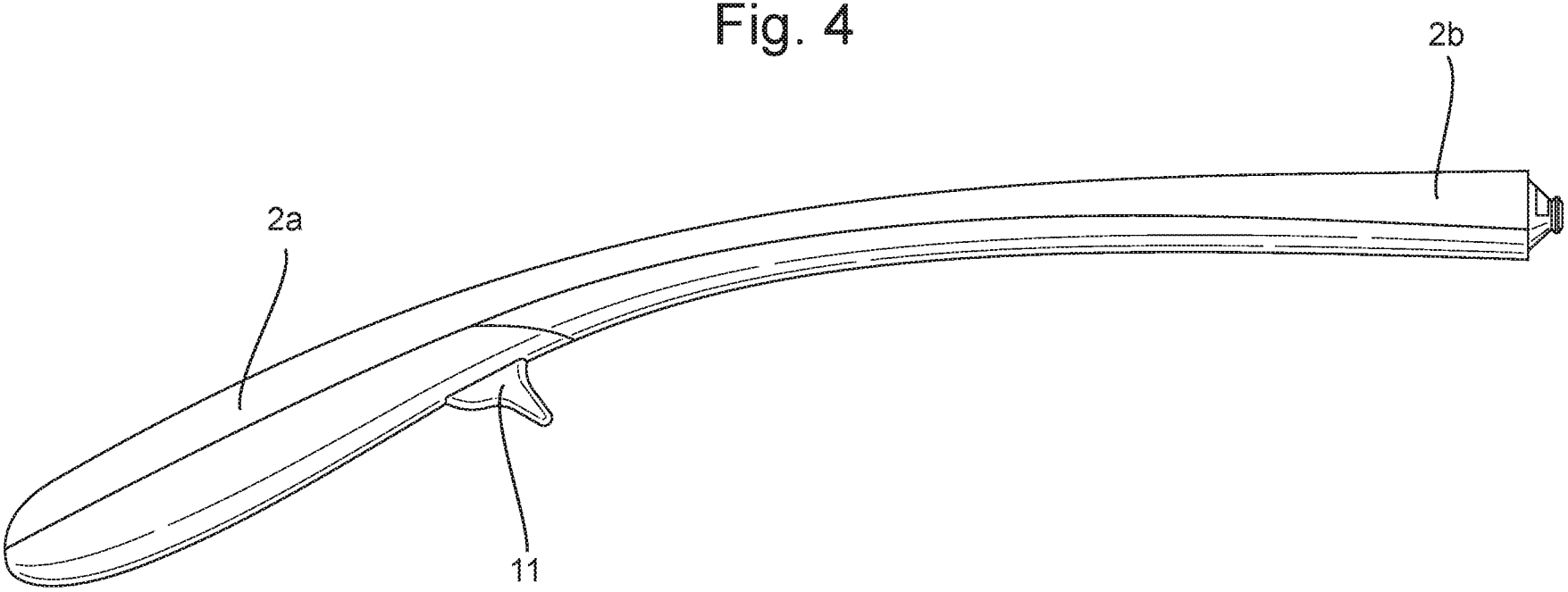

With reference to FIGS. 3 and 4 more detail of the handle (2) can be seen. The handle has two sections: an upper section (2*a*) ergonomically shaped for a user's hand and a lower section (2*b*).

The upper section (2*a*) includes a trigger (11) which is associated with the release mechanism With reference to 5 to 7 more detail of alternative embodiments of the back plate (7) brush head (3) of the invention can be seen. (Not all detail of the brush head (3) and/or back plate (7) are shown—these figures focus on the additional/alternative feature(s)).

Figure 5:
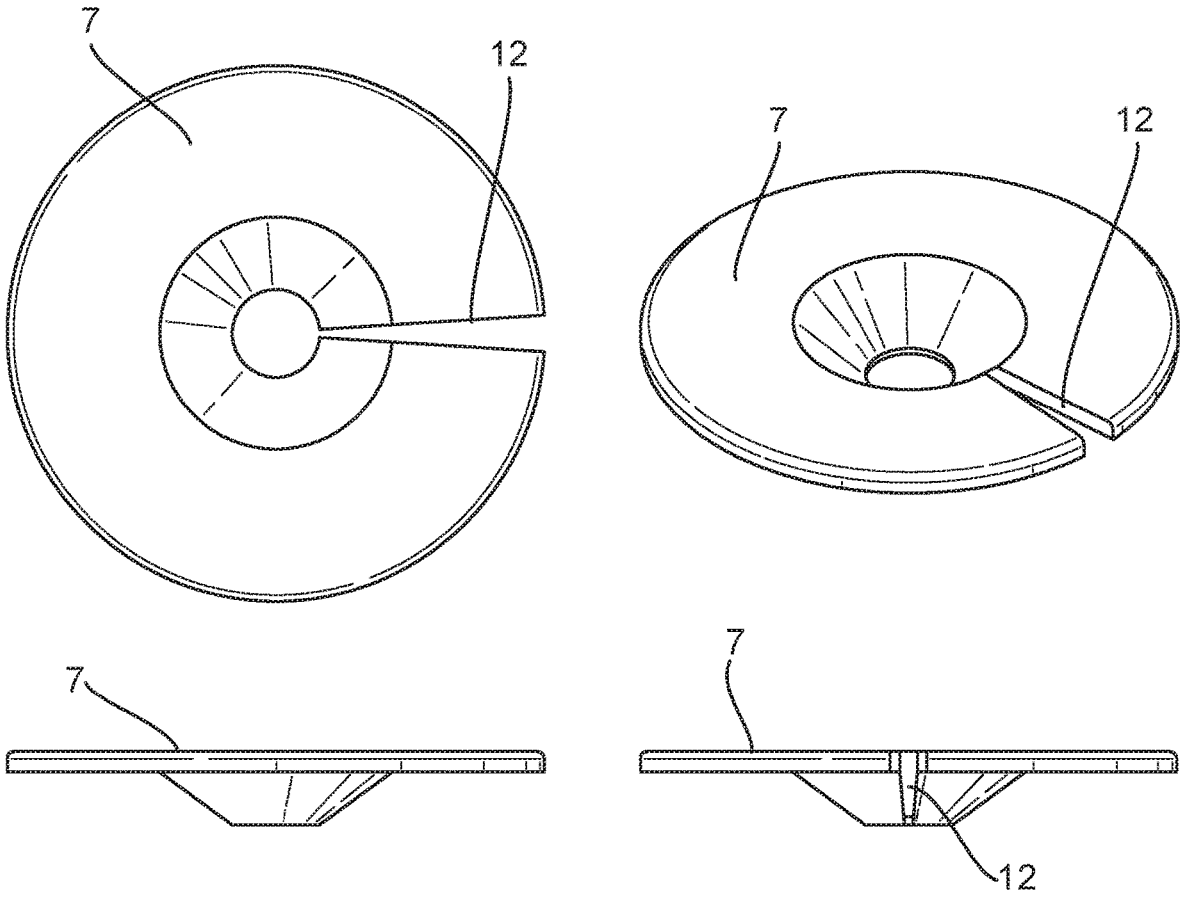
FIGS. 5 to 7 are views of alternative embodiments of the brush head of the invention.

In FIG. 5 the back plate (7) has a slit (12). The slit (12) can open on insertion of the bayonet section (4).

Figure 6:
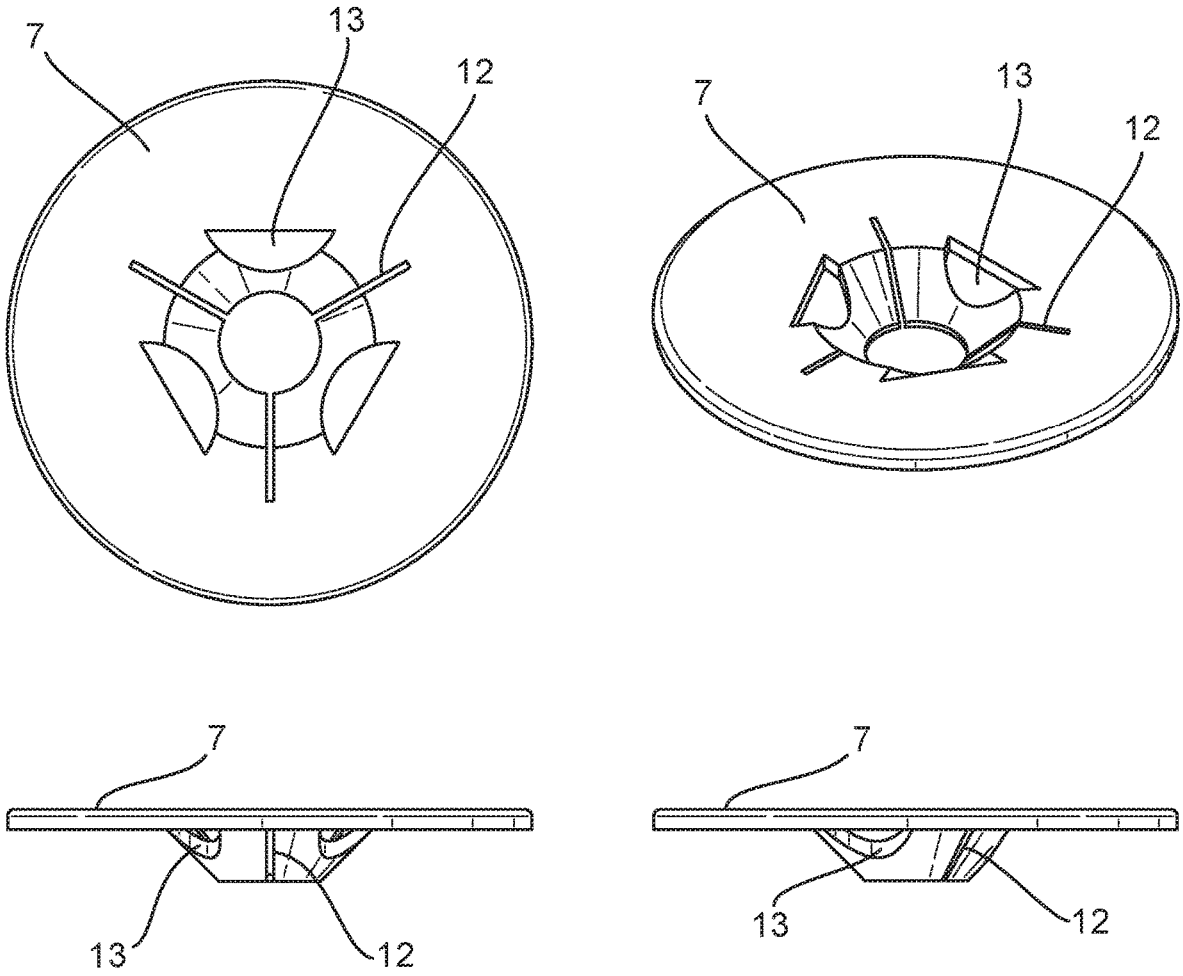

In FIG. 6 the back plate (7) has a plurality of slits (12) and associated openings (13). The slits (12) can open on insertion of the bayonet section (4), aiding its insertion.

Figure 7:
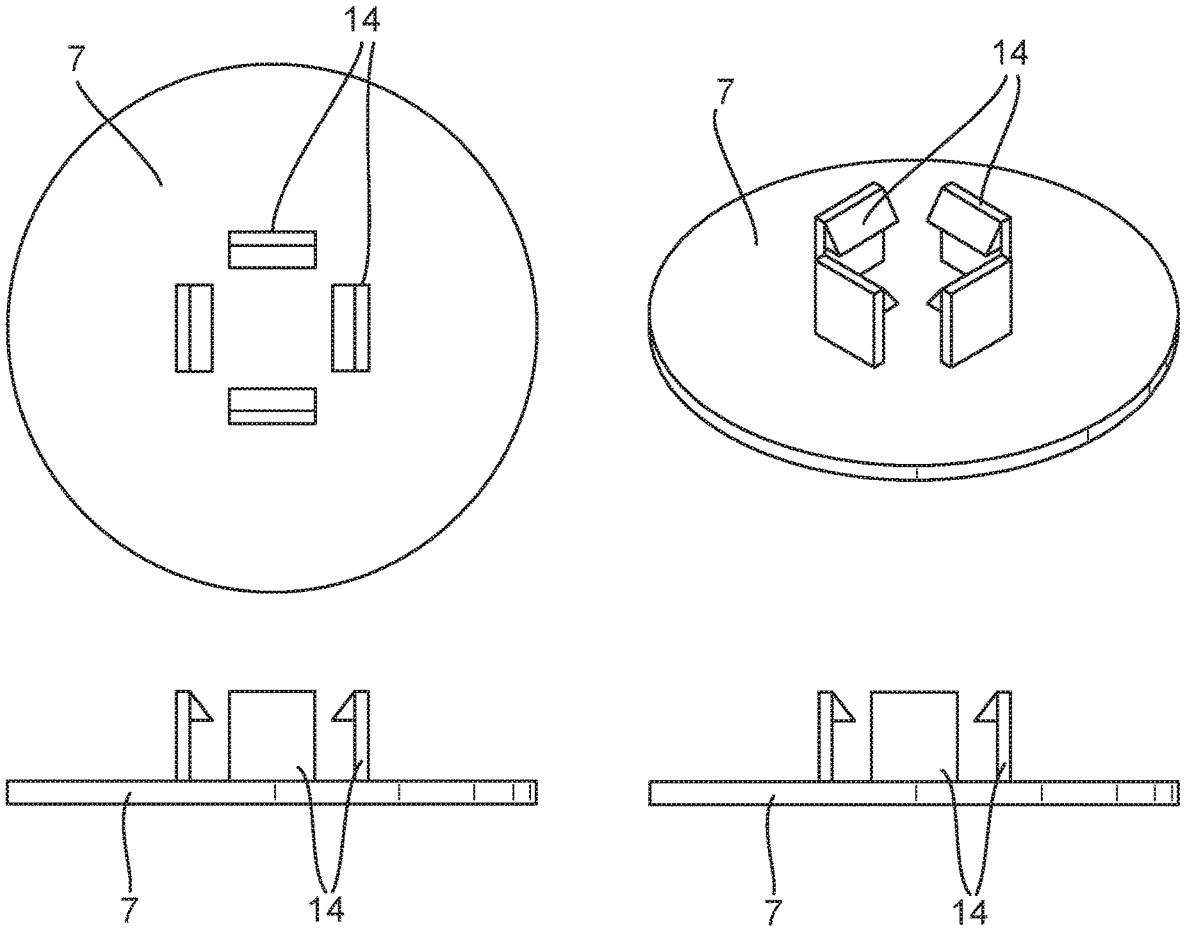

In FIG. 7 the back plate (7) has a plurality of raised teeth (14). The teeth (14) can engage a portion of the bayonet section (4) on insertion of the bayonet section (4).

Figure 8:
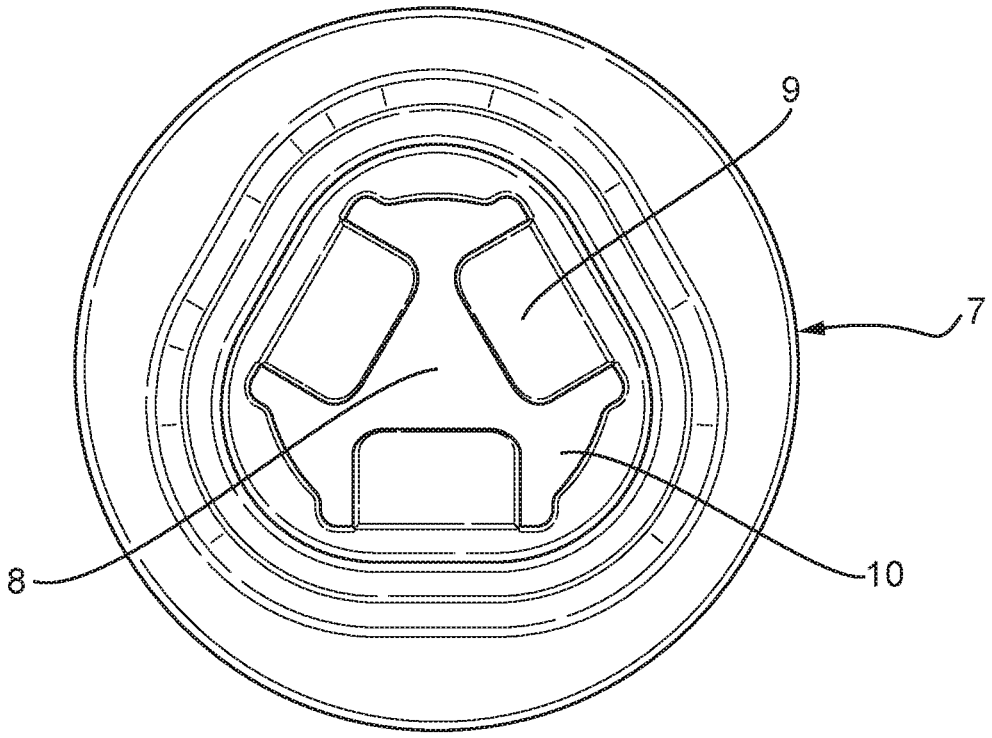
FIG. 8 shows a top view of a brush head.

FIG. 8 show a top view of a brush head having teeth 9 angled with respect to the planar surface of the back plate 7. As illustrated in FIG. 8, the teeth 9 are angled away from the back plate towards the cleaning surface of the brush head. The angled teeth 9 reduce the risk of accidental pull off of the brush head 3 from the handle 2.

In the example illustrated the teeth are angled away from the handle portion as the user inserts the handle onto the brush head. This allows the angle of the teeth to correspond more closely to the angle of the bayonet section 4 of the handle relative to teeth that are co-planar to the back plate. Angling the teeth to more closely align with the bayonet section 4 may increase the pull off force required whilst requiring the same or lower force to push the brush head onto the handle.

In an example, the brush head comprises teeth that are angled between 70 degrees and 30 degrees inwards from the back plate towards the cleaning surface of the brush head, for example the teeth may be angled between 60 degrees and 35 degrees inwards from the back plate, for example the teeth may be angled between 50 degrees and 40 degrees inwards from the back plate, for example the teeth may be angled at 45 degrees inwards from the planar back plate.

In an example, the brush head may comprise one to five teeth, for example two to four teeth, for example three teeth.

The teeth may also be angled relative to the brush head so that the teeth are angled to correspond to the angle of the conical part of the bayonet section as the brush head is placed on the handle. Angling the teeth to correspond to the angle of the conical part of the brush head means that the teeth are under stress when the handle is in place on the brush head. The stressed teeth increase the frictional force between the brush head and the handle. The increase the force required to rotate the brush head whilst it is in place on the handle and can help to reduce excessive rotation of the head during use.

Figure 9:
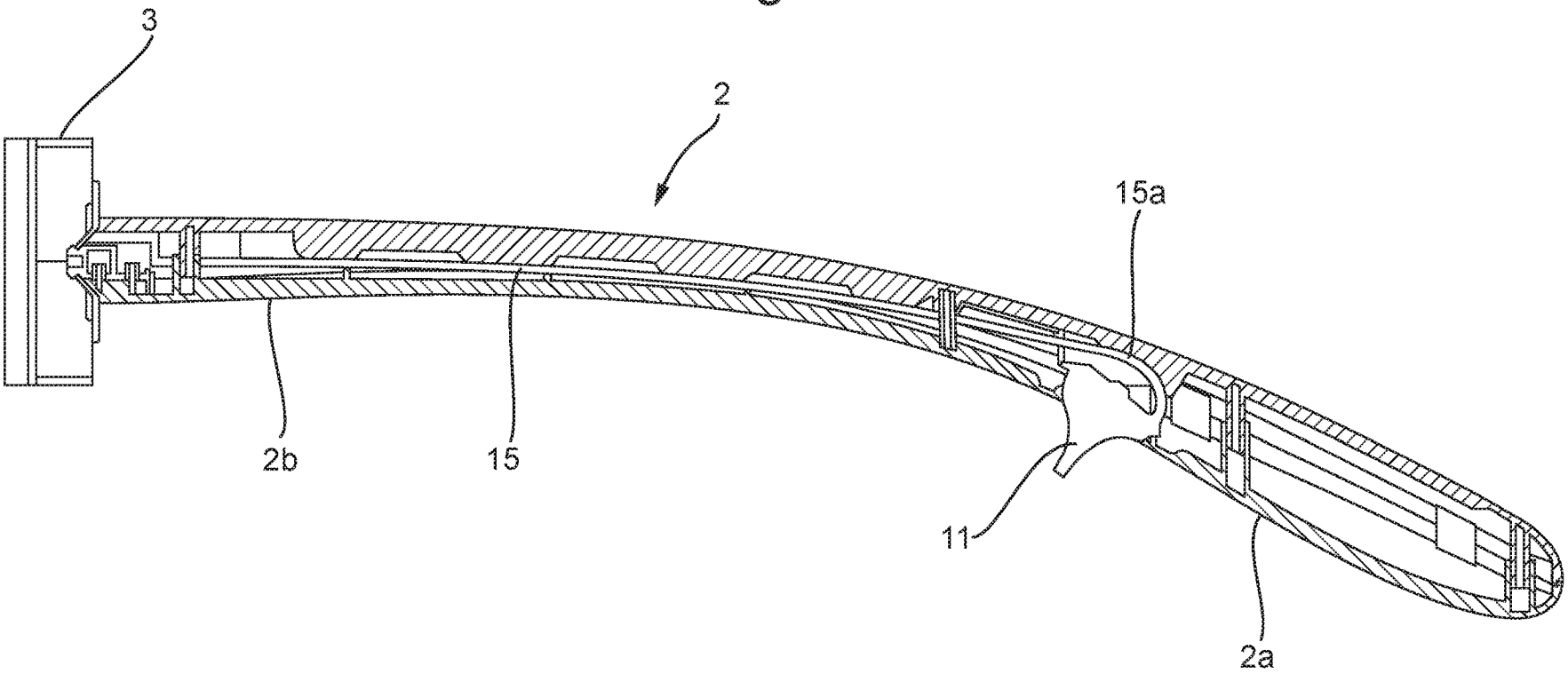
FIG. 9 shows an example of an ejection mechanism.

FIG. 9 shows an example of an ejection mechanism with a brush head 3 in place on a handle 2. The handle 2 has an upper section 2*a* located at the distal end and a lower section 2*b* located at the proximal end. The release mechanism 15 is coupled to a trigger 11 at the distal end. As shown in FIG. 9, the release mechanism 15 comprises a curved section 15*a* at the distal end and is coupled to the release rods (not shown) at the proximal end. The curved section 15*a* has a spring action and helps to transfer the force from the button or trigger to the ejection rods. In the example illustrated in FIG. 9, the trigger 11 is rotated to release brush head 3. The rotation of the trigger transfers a force via the release mechanism 15 to one or more rods which, in turn, push against one or more teeth to release the brush head.

Further modifications and developments can be made without departing from the scope of the invention described herein.

The invention claimed is:

1. A brush head comprising a back plate and a brushing section, wherein the back plate includes an opening having a gripping mechanism comprised of teeth formed by slots radiating outwardly from the opening, said teeth being suitable for gripping a handle and said teeth being flexible enough that a user can insert the handle into the opening for retention.

2. A kit comprising a handle and a number of brush heads according to claim 1.

3. A toilet brush comprising a handle and a brush head, wherein the handle has a release mechanism for releasing the brush head comprising a trigger configured to disengage the handle from the brush head, wherein the brush head has a handle engagement means which comprises an opening configured to accept the handle, the opening having a gripping mechanism comprising teeth formed by slots radiating outwardly from the opening, said teeth being suitable for gripping the handle and said teeth being flexible enough that a user can insert the handle into the opening for retention, wherein the handle comprises a recessed lip to be retained by the teeth, wherein the brush head can be detachably pushed onto the handle.

4. The brush of claim 3, wherein the gripping mechanism comprises three teeth.

5. The brush of claim 3, wherein the teeth comprise a resilient material.

6. The brush of claim 3, wherein the release mechanism for the brush head comprises a sleeve which can slide on the handle, the sleeve terminates in a plurality of rods which cause disengagement of teeth with the handle.

7. The brush of claim 6, wherein the release mechanism is moved by a pushbutton.

8. A method of cleaning a toilet and/or a sanitary appliance, comprising the step of:

contacting a surface of the toilet and/or sanitary appliance with the brush of claim 3.

9. The method of claim 8, wherein the method includes the steps of:

removing the brush head from the surface, and subsequently disposing of the brush head.

10. The brush of claim 3, wherein the brush head comprises a back plate which includes the opening.

11. The brush head of claim 10, wherein the teeth are arranged to angle inwards from the back plate.

12. The brush head of claim 11, wherein the teeth are between 60 degrees and 35 degrees inwards from the back plate.

13. The brush head according of claim 11, wherein the teeth are angled so that they are placed under stress when receiving the handle so that the teeth exert a force on the recessed lip to be retained by the theeth.

14. The brush of claim 10, wherein the brush head comprises a brushing section adjacent to the back plate and distant from the handle.

15. The brush of claim 14, wherein the brushing section comprises a volume of sponge and/or foam.

16. The brush of claim 14, wherein the brushing section comprises bristles.

17. The brush of claim 14, wherein the brushing section comprises a pad and/or sheet formed of a non-woven and/or woven material.

18. The brush of claim 14, wherein the brushing section is impregnated and/or coated with a toilet cleaning formulation.

19. A method of placing a brush handle on a brush head, the method comprising:

pushing the brush handle which comprises a recessed lip and a teeth flex onto the brush head comprising a back plate and a brushing section, to thereby removably attach the brush head to the handle, wherein the, back plate of the brush head comprises a gripping mechanism having teeth and pushing the handle onto the brush head flexes the teeth;

allowing the teeth flex to pass over the recessed lip as the handle is pushed onto the brush head and coupling the teeth with the recessed lip to retain the handle on the brush head.

* * * * *